US005466364A

United States Patent [19]

Kaul et al.

[11] Patent Number: 5,466,364

[45] Date of Patent: Nov. 14, 1995

[54] PERFORMANCE OF CONTAMINATED WAX ISOMERATE OIL AND HYDROCARBON SYNTHESIS LIQUID PRODUCTS BY SILICA ADSORPTION

[75] Inventors: Bal K. Kaul, Randolph; Craig Y. Sabottke, Morristown; Rocco A. Fiato, Basking Ridge; Edward Niessen, Passaic, all of N.J.

[73] Assignee: Exxon Research & Engineering Co., Florham Park, N.J.

[21] Appl. No.: 87,309

[22] Filed: Jul. 2, 1993

[51] Int. Cl.[6] ..... C10G 25/00

[52] U.S. Cl. ..... 208/307; 208/300; 208/99; 208/263; 585/823; 585/824

[58] Field of Search ..... 208/99, 263, 300, 208/307; 585/823, 824

[56] References Cited

U.S. PATENT DOCUMENTS

| | | | |
|---|---|---|---|
| 2,007,114 | 7/1935 | Stratford | 208/99 |
| 2,084,510 | 6/1937 | Showalter | 208/2 |
| 2,155,704 | 4/1939 | Goodall et al. | 23/251 |
| 2,356,890 | 8/1944 | Schulze | 196/4 |
| 2,548,502 | 4/1951 | Small | 183/114.2 |
| 2,754,343 | 7/1956 | Maisel | 260/674 |
| 2,756,197 | 7/1956 | Thorpe et al. | 196/147 |
| 2,789,081 | 4/1957 | Mills | 208/263 |
| 3,233,003 | 2/1966 | Epperly et al. | 585/823 |
| 3,272,742 | 9/1966 | Polishuk | 252/28 |
| 3,438,892 | 4/1969 | Wymore et al. | 210/32 |
| 3,529,944 | 9/1970 | Leas | 44/70 |
| 3,620,969 | 11/1971 | Turnock | 208/245 |
| 3,671,423 | 6/1972 | McDonald et al. | 208/97 |
| 3,684,684 | 8/1972 | Coleman | 208/28 |
| 3,810,950 | 5/1974 | Woodle | 208/99 |
| 3,853,749 | 12/1974 | Espenscheid et al. | 208/307 |
| 4,312,845 | 1/1982 | Wason | 423/339 |
| 4,367,364 | 1/1983 | Kulprathipaman et al. | 208/310 R |
| 4,502,948 | 3/1985 | Tabler | 208/183 |
| 4,561,967 | 12/1985 | Miller | 208/120 |
| 4,600,502 | 7/1986 | Butler et al. | 208/284 |
| 4,719,007 | 1/1988 | Johnson et al. | 208/99 |
| 4,770,763 | 9/1988 | Kusayangi et al. | 208/99 |
| 4,832,819 | 5/1989 | Hamner | 208/27 |
| 4,846,962 | 7/1989 | Yao | 208/301 |
| 4,919,786 | 4/1990 | Hamner et al. | 208/27 |
| 4,923,588 | 5/1990 | Cody et al. | 208/27 |
| 4,943,672 | 7/1990 | Hamner et al. | 585/737 |
| 5,053,169 | 10/1991 | Price | 260/428 |
| 5,186,819 | 2/1993 | Kaul et al. | 208/310 |
| 5,190,633 | 3/1993 | Fetzer et al. | 208/99 |

FOREIGN PATENT DOCUMENTS

| | | | |
|---|---|---|---|
| 321305 | 6/1989 | European Pat. Off. | C10G 45/62 |
| 2453211 | 12/1980 | France . | |
| 826144 | 12/1959 | United Kingdom . | |
| 1168027 | 10/1969 | United Kingdom | C10G 24/12 |

*Primary Examiner*—Asok Pal
*Assistant Examiner*—Walter D. Griffin
*Attorney, Agent, or Firm*—Joseph J. Allocca

[57] ABSTRACT

The daylight stability, foaming characteristics, color, engine performance test behavior, oxygenates content, and thermal stability of wax isomerate oils and/or hydrocarbon synthesis liquid products are improved by the process of contacting the aforesaid wax isomerate oil and/or hydrocarbon synthesis liquid products with a silica adsorbent, said silica adsorbent being characterized by possessing a pore size of at least about 100 Å, preferably at least about 125 Å, most preferably at least about 150 Å, an alkali/alkaline earth ion concentration, excluding sodium, of greater than about 125 ppm, an iron content of less than about 40 ppm and a zirconium content of less than about 130 ppm.

7 Claims, No Drawings

PERFORMANCE OF CONTAMINATED WAX ISOMERATE OIL AND HYDROCARBON SYNTHESIS LIQUID PRODUCTS BY SILICA ADSORPTION

BRIEF DESCRIPTION OF THE INVENTION

Wax isomerate oils and/or hydrocarbon synthesis liquid products (also known as gas conversion liquid products) which are contaminated and thereby have unacceptable thermal stability, oxygenates content, color, daylight stability, engine performance test results and foaming characteristics can be improved in terms of those characteristics by the process involving contacting the oil or liquid product with silica which possesses a pore size of at least about 100 Å, an alkali/alkaline earth ion content, excluding sodium, of greater than about 125 ppm, an iron content of less than 40 ppm and a zirconium content of less than 130 ppm.

BACKGROUND OF THE INVENTION

Lubricating oils produced using wax isomerate oils and/or hydrocarbon synthesis liquid products as either the base oil or an additive component, must meet strict performance guidelines in terms of color, daylight stability, oxygenates content, engine performance test results, foaming tendency and thermal stability. The use of wax isomerate oils and/or hydrocarbon synthesis liquid products as base oils per se or as additive components of formulate lube or specialty oils (e.g. transmission fluids, refrigerator oils, electrical oils etc.) has associated with such use the necessity of overcoming and/or otherwise mitigating or removing certain negative characteristics of said oils which hamper or otherwise impede the use of such oils in such service. These oils, in the course of manufacture, and/or during shipment or storage, pick up significant quantities of oxygenates which are detrimental.

It has long been known that the presence of oxygenates in oil base stocks is to be avoided. The literature describes various methods for effecting this desired goal.

U.S. Pat. No. 3,529,944 teaches that a hydrocarbon oil can have its oxidation performance improved by the steps of adding an oxidation promoter to the oil to produce oxidation products, then filtering the oil through a solid, particulate, adsorbent media to remove the impurities. Suitable adsorbents include in general natural or synthetic clays, fuller's earth, attapulgite, silica gel and adsorbent catalyst.

U.S. Pat. No. 3,684,684 teaches the production of lube oils stable to ultra-violet light and having improved color and viscosity index by severe hydrogenation, dewaxing and clay contacting lubricating oil fractions. Clay contacting is effected using as the adsorbent agent fuller's earth, attapulgite clay, porocel clay, bauxite, silica or mixtures thereof.

U.S. Pat. No. 3,671,423 improves the light and air stability of hydrocracked high boiling fractions by percolating the oil fraction through silica-alumina gels containing a Y-type molecular sieve.

U.S. Pat. No. 4,561,967 teaches a method of stabilizing lube oil by contacting the oil with an intermediate pore size zeolite having a silica to alumina ratio of greater than about 200:1 in the hydrogen form and wherein the zeolite does not contain any hydrogenation component, the contacting being performed in the absence of hydrogen, at a pressure of less than 13 bar, a temperature of between about 260° to 610° C. and a LHSV of 0.5 to 200.

Despite these teachings, it would be a benefit if a low cost, low energy, repeatable process could be found for improving the color, daylight stability, oxygenates content, thermal stability, foaming characteristics and engine performance test results of wax isomerate oils and/or hydrocarbon synthesis liquid products used as base oils or additives in the production of lubricating oils, transformer fluids, refrigerator or insulating oils or other speciality oil products.

DESCRIPTION OF THE INVENTION

It has been discovered that wax isomerate oils, hydrocarbon synthesis liquid products, and mixtures thereof which are contaminated and therefore have unacceptable thermal stability, color, oxygenates content, daylight stability, foaming characteristics and engine performance test behavior can be improved with respect to the aforesaid characteristics by the process comprising contacting said contaminated isomerate oils contaminated hydrocarbon synthesis liquid products and mixtures thereof with a silica adsorbent, said silica adsorbent being characterized by possessing a pore size of at least 100 Å, preferably at least 125 Å, most preferably at least 150 Å, an alkali/alkaline earth ion concentration, excluding sodium, of greater than about 125 ppm, preferably greater than about 150 ppm, more preferably greater than about 300 ppm, most preferably greater than about 800 ppm, an iron content of less than about 40 ppm, preferably less than about 30 ppm, most preferably less than about 25 ppm and a zirconium content of less than about 130 ppm, preferably less than about 115 ppm, most preferably less than about 100 ppm. The wax isomerate oils and/or hydrocarbon synthesis liquid products are contacted with the particular silica adsorbent at a silica loading level of greater than about 1 ml/gram, preferably about 2.5 to 3000 ml/gram, most preferably about 10 to 156 ml/gram, at any convenient temperature, e.g., a temperature ranging from just above the solidification point of the oil to just below the boiling point, preferably from about ambient temperature to 100° C., and at any convenient pressure, e.g., a pressure ranging from about atmospheric to about 50 atm, preferably about atmospheric to about 10 atm. Contacting is conducted for a time sufficient to adsorb oxygenates onto the silica and, in general, has no upper limit but is usually less than 2 hours ranging from about 2 minutes to about 2 hours, preferably about 10 minutes to about 1 hour, most preferably about 10 minutes to about 30 minutes.

Contacting can be performed in batch mode, e.g., a volume of oil is added to a volume of adsorbent, permitted to stand, then the oil is drained and a new oil charge is added.

Alternatively contacting can be performed under continuous conditions using a fixed bed, moving bed, simulated moving bed or magnetically stabilized fluidized bed and employing either upflow or downflow continuous oil circulation; preferably the mode of operation should be downflow. The bed is static in the upflow mode, with a contact time of about 10 minutes to about 30 minutes.

The adsorbent is regenerated by passing a desorbent over the adsorbent when the adsorbent has reached the limit of its capacity, as evidenced by the effluent oil failing to achieve any one of its target performance goals, e.g., color break through or foaming test failure etc. The desorbent can be toluene, methanol, methylene chloride, etc., in general any solvent which will dissolve adsorbed oxygenate contaminants. The desorbent should have a boiling point at least 10° C. different from that of the oxygenate contaminants to facilitate separation and desorbent recycle. The regenerated adsorbent is then available for reuse while the desorbent can be sent to a distillation zone for recovery and recycle. The concentrated contaminant can be handled in accordance with procedures appropriate to its constituents. Thus, an integrated process is envisioned involving subjecting the oil to an adsorbent as described herein, regenerating the adsorbent using a desorbent solvent when it becomes saturated with contaminant, recycling the adsorbent and recovering the desorbent for reuse.

The oils which are benefitted by this silica adsorption process are the wax isomerate oils and/or hydrocarbon synthesis liquid products used as base oils or additive oils in the production of lube or specialty oils.

Wax isomerate oils are, in general, those oils produced by the isomerization of wax over an isomerization catalyst, such as a group VI or VIII metal on halogenated refractory metal oxide catalyst and boiling in the 330° C.+ range preferably in the 330° to about 600° C. range. See, in particular U.S. Pat. No. 5,059,299 for a preferred wax isomerization process. The wax which is isomerized can be either a slack wax recovered by the solvent dewaxing of petroleum hydrocarbon oils or a synthetic wax produced by the Fischer Tropsch process conversion of CO and $H_2$ into paraffins.

As one would expect isomerization catalysts are susceptible to deactivation by the presence of heteroatom compounds (i.e. N or S compounds) in the wax feed so care must be exercised to remove such heteroatom materials from the wax feed charges. When dealing with high purity waxes such as synthetic Fischer-Tropsch waxes such precautions may not be necessary. In such cases subjecting such waxes to very mild hydrotreating may be sufficient to insure protection for the isomerization catalyst. On the other hand waxes obtained from natural petroleum sources contain quantities of heteroatom compounds as well as appreciable quantities of oil which contain heteroatom compounds. In such instances the slack waxes should be hydrotreated to reduce the level of heteroatoms compounds to levels commonly accepted in the industry as tolerable for feeds to be exposed to isomerization catalysts. Such levels will typically be a N content of about 1 to 5 ppm and a sulfur content of about 1 to 20 ppm, preferably 2 ppm or less nitrogen and 5 ppm or less sulfur. The hydrotreating step will employ typical hydrotreating catalyst such as Co/Mo, Ni/Mo, or Ni/Co/Mo on alumina under standard, commercially accepted conditions, e.g., temperature of 280° to 400° C., space velocity of 0.1 to 2.0 V/V/hr, pressure of from 500 to 3000 psig $H_2$ and hydrogen gas rates of from 500 to 5000 SCF/g.

When dealing with Fischer-Tropsch wax it is preferred, from a processing standpoint, to treat such wax in accordance with the procedure of U.S. Pat. No. 4,943,672. Fischer-Tropsch wax is treated with a hydrotreating catalyst and hydrogen to reduce the oxygenate and trace metal levels of the wax and to partially hydrocrack/isomerize the wax after which it is hydroisomerized under conditions to convert the hydrotreated Fischer-Tropsch wax to distillate and lighter fractions (650° F.–) by being contacted in hydroisomerization zone with a fluorided Group VIII metal-on-alumina catalyst.

In U.S. Pat. No. 4,943,672 the hydrotreating is under relative severe conditions including a temperature in the range 650° F. to 775° F., (about 343° to 412° C.), a hydrogen pressure between about 500 and 2500 psig, a space velocity of between about 0.1 and 2.0 v/v/hr and a hydrogen gas rate between about 500 and 5000 SCF/bbl. Hydrotreating catalysts include the typical Co/Mo or Ni/Mo on alumina as well as other combinations of Co and/or Ni and Mo and/or W on a silica/alumina base. The hydrotreating catalyst is typically presulfided but it is preferred to employ a non-sulfided hydrotreating catalyst.

Isomerization is conducted under conditions of temperatures between about 270° to 400° C., preferably 300°–360° C., pressures of 500 to 3000 psi $H_2$, preferably 1000–1500 psi $H_2$, hydrogen gas rates of 1000 to 10,000 SCF/bbl, and a space velocity in the range 0.1–10 v/v/hr, preferably 1–2 v/v/hr.

Following isomerization the isomerate is fractionated into a lubes cut and fuels cut, the lubes cut being identified as that fraction boiling in the 330° C.+ range, preferably the 370° C.+ range or even higher. This lubes fraction is then dewaxed to a pour point of about –21° C. or lower. Dewaxing is accomplished by techniques which permit the recovery of unconverted wax, since in the process of the present invention this unconverted wax is recycled to the isomerization unit. It is preferred that this recycle wax be recycled to the main wax reservoir and be passed through the hydrotreating unit to remove any quantities of entrained dewaxing solvent which solvent could be detrimental to the isomerization catalyst. Alternatively, a separate stripper can be used to remove entrained dewaxing solvent or other contaminants. Since the unconverted wax is to be recycled dewaxing procedures which destroy the wax such as catalytic dewaxing are not recommended. Solvent dewaxing is utilized and employs typical dewaxing solvents. Solvent dewaxing utilizes typical dewaxing solvents such as $C_3$–$C_6$ ketones (e.g. methyl ethyl ketone, methyl isobutyl ketone and mixtures thereof), $C_6$–$C_{10}$ aromatic hydrocarbons (e.g. toluene) mixtures of ketones and aromatics (e.g. MEK/toluene), autorefrigerative solvents such as liquified, normally gaseous $C_2$–$C_4$ hydrocarbons such as propane, propylene, butane, butylene and mixtures thereof, etc. at filter temperature of –25° to –30° C. The preferred solvent to dewax the isomerate especially isomerates derived from the heavier waxes (e.g. bright stock waxes) under miscible conditions and thereby produce the highest yield of dewaxed oil at a high filter rate is a mixture of MEK/MIBK (20/80 v/v) used at a temperature in the range –25° to –30° C.

U.S. Pat. No. 5,158,671 reports that it has also been found that prior to fractionation of the isomerate into various cuts and dewaxing said cuts the total liquid product (TLP) from the isomerization unit can be advantageously treated in a second stage at mild conditions using the isomerization catalyst or simply noble Group VIII on refractory metal oxide catalyst to reduce PNA and other contaminants in the isomerate and thus yield an oil of improved daylight stability.

In that embodiment the total isomerate is passed over a charge of the isomerization catalyst or over just noble Gp VIII on e.g. transition alumina. Mild conditions are used, e.g., a temperature in the range of about 170°–270° C., preferably about 180° to 220° C., at pressures of about 300 to 1500 psi $H_2$, preferably 500 to 1000 psi $H_2$, a hydrogen gas rate of about 500 to 10,000 SCF/bbl, preferably 1000 to 5000 SCF/bbl and a flow velocity of about 0.25 to 10 v/v/hr., preferably about 1–4 v/v/hr. Temperatures at the high end of the range should be employed only when similarly employing pressures at the high end of their recited range. Temperatures in excess of those recited may be employed if pressures in excess of 1500 psi are used, but such high pressures may not be practical or economic.

The total isomerate can be treated under these mild conditions in a separate, dedicated unit or the TLP from the isomerization reactor can be stored in tankage and subsequently passed through the aforementioned isomerization reactor under said mild conditions. It has been found to be unnecessary to fractionate the 1st stage product prior to this mild 2nd stage treatment. Subjecting the whole product to this mild second stage treatment produces an oil product which upon subsequent fractionation and dewaxing yields a base oil exhibiting a high level of daylight stability and oxidation stability. These base oils can be subjected to subsequent hydrofinishing using conventional catalysts such as KF-840 or HDN-30 (e.g. Co/Mo or Ni/Mo on alumina) at conventional conditions to remove undesirable process impurities to further improve product quality.

While any wax isomerate oil can be benefitted by the present process the preferred oil is typically that fraction having a pour point of about −18° C. or lower, a viscosity index of at least 140, a kinematic viscosity @100° C. (cSt) of 5.6–5.9, a Noack volatility (% wt loss) of 9.0 maximum and a flash point of about 230° C. minimum.

The oils which are benefitted by the present silica adsorption process are also the liquid products secured by the Fischer-Tropsch process conversion of CO and $H_2$ (gas conversion liquid products). In this case the liquid product boiling in the about 320° to about 700° F. range is subjected to the silica adsorption process. The solid, waxy Fischer-Tropsch product can be isomerized as described above and the isomerate oil by itself or combined with the light liquid production fraction recovered from the Fischer-Tropsch process then treated in accordance with the silica adsorption process of the present invention. See, for example, U.S. Pat. No. 4,832,819.

The wax isomerate oil fractions and/or hydrocarbon synthesis liquid products are contacted with the silica in any way convenient to the practitioner. Thus, batch or continuous contacting, upflow or downflow configuration are equally acceptable.

Contacting is conducted similarly under conditions of temperature and pressure convenient to the practitioner. Temperature used is generally such that the oil is in the liquid state (i.e., between the solidification and boiling point of the oil), preferably in the range of about 20° to 100° C. Pressure used is generally in the range of atmospheric to about 30 atm, preferably atmospheric to about 10 atm.

Contacting time is generally less than 2 hours and ranges from about 2 minutes to 2 hours, preferably about 10 minutes to about 1 hour, most preferably about 10 minutes to about 30 minutes.

It has been found that in order for the wax isomerate oil fractions and/or hydrocarbon synthesis liquid product fraction to exhibit improved color, daylight stability, thermal stability, foaming characteristics, engine performance test result and oxygenates content, the adsorption step must employ silica adsorbent characterized by having a pore size of at least about 100 Å, preferably about 125 Å, most preferably about 150 Å, an alkali/alkaline earth ion content, excluding sodium, of greater than about 125 ppm, preferably greater than about 150 ppm, more preferably greater than about 300 ppm, most preferably greater than about 800 ppm, an iron content of less than about 40 ppm, preferably less than about 30 ppm, most preferably less than about 25 ppm and a zirconium content of less than about 130 ppm, preferably less than about 115 ppm, most preferably less than about 100 ppm, preferred silica meeting the above described requirements in silica gel 646 from W. R. Grace & Co.

By improved color is meant that the adsorbent treatment produces a stream having an ASTM color of <0.5, preferably 0 as determined by ASTM-D1500 test method.

By improved thermal stability is meant that there is no increase in oxygenates level or degradation of the base oil by direct quantitative measurement. Thermal stability is determined by heating the oil sample in air to about 200° C. and holding it at that temperature. The target is no increase in base line (time zero) oxygenates over a period of about 45 days. Stability to degradation is determined by simply measuring sludge formation in oil that is just standing (in the dark) at ambient temperature. The target is no increase in sludge over the base line value (time zero) over about 45 days.

By improved daylight stability is meant the oil holds the color specification established for it by the practitioner overtime when exposed to sunlight. Typically a target period of 45 days stability is considered excellent.

By improved oxygenate content is meant the oil possesses less than 500 ppm oxygenates.

By improved foaming tendency is meant that the foam height is less than 80 mls, preferably less than 60, mls when evaluated under ASTM D892 method.

By improved engine performance test result is meant that the oil exhibits both Lacquer merit and carbon groove fill values of a clean 150N oil. (See Obert, F. Edward, "Internal Combustion Engines and Air Pollution" Harper & Row, Publishers, Inc., New York 1973.)

The object therefore is to produce an oil product which after adsorbent treatment meets the following targets or specifications:

| | |
|---|---|
| Color - clear and bright | (<0.5) (specification) |
| Total uncatalyzed and catalyzed acid Petter W - 1 Test | <50 (Target) |
| Lacquer Merit | approaching 10, (on a scale of zero to 10) (perfect clean) |
| Land 2 Carbon Fill Test | 6.0 (minimum) (Target) |
| Grove 1 | 40% (max) (Target) |
| Grove 2 | 40% (max) (Target) |
| Foam Fully Formulated foam | |
| Stage 1 | <50–0 |
| Stage 2 | <50–0 |
| Stage 3 | <50–0 |

EXAMPLES

Example 1

Silica gel #646 and silica gel #12 were analyzed using inductively coupled plasma/atomic emission spectroscopy. The results are reported in Tables 1 and 2.

TABLE 1

| Silica Gel #646 | | | Units: PPM | | |
|---|---|---|---|---|---|
| Init. Vol. or Wt. | | Final Vol. or Wt. | | Multiplier | Dilution Factor |
| 2.5117 | | 50.0000 | | 1.0000 | 19.9068 |
| | | Selected Group: Ashed with $H_2SO_4$ & ZR | | | |
| Element: | AL | BE | BI | CA | CD | CO |
| Conc: | 137 | ND < 0.050 | ND < 1.4 | 730 | ND < 0.12 | (0.2) |
| [Confid.] | [100] | [100] | [100] | [100] | [100] | [100] |
| | CR | CU | FE | K | LI | MG |
| | 0.56 | ND < 0.040 | 39.0 | (48) | (0.2) | 167 |
| | [100] | [100] | [100] | [100] | [100] | [100] |
| | MN | MO | NA | NI | PB | SB |
| | ND < 0.080 | ND < 0.20 | 483 | ND < 0.42 | ND < 0.40 | ND < 1.1 |
| | [100] | [100] | [100] | [100] | [100] | [100] |
| | TL | V | Y | ZN | ZR | |
| | (1) | (0.1) | ND < 0.100 | 0.12 | 128 | |
| | [20] | [78] | [100] | [100] | [100] | |

Sum of Reported Elements: 1730 PPM
Sum Calculated as Oxides: 2500 PPM Silica Gel #646, pore size 150Å Alkaline/Alkaline Earth Element Content (Ca, K, Li, Mg excluding Na) plus Zn = 945.32 PPM

TABLE 2

| Silica Gel #12 | | | Units: PPM | | |
|---|---|---|---|---|---|
| Init. Vol. or Wt. | | Final Vol. or Wt. | | Multiplier | Dilution Factor |
| 2.5048 | | 50.0000 | | 1.0000 | 19.9617 |
| | | Selected Group: Ashed with $H_2SO_4$ & ZR | | | |
| Element: | AL | BE | BI | CA | CD | CO |
| Conc: | 127 | ND < 0.050 | ND < 1.4 | 25.8 | ND < 0.12 | (0.1) |
| [Confid.] | [100] | [100] | [100] | [100] | [100] | [99] |
| | CR | CU | FE | K | LI | MG |
| | 0.73 | (0.94) | 49.0 | ND < 10.0 | ND < 0.060 | 7.90 |
| | [100] | [94] | [100] | [100] | [100] | [98] |
| | MN | MO | NA | NI | PB | SB |
| | ND < 0.080 | (0.94) | 570 | ND < 0.42 | (0.9) | ND < 1.1 |
| | [100] | [100] | [100] | [100] | [95] | [100] |
| | TL | V | Y | ZN | ZR | |
| | (2) | 0.31 | ND < 0.100 | 0.39 | 162 | |
| | [28] | [84] | [100] | [100] | [100] | |

Sum of Reported Elements: 948 PPM
Sum Calculated as Oxides: 1350 PPM Silica Gel #12, pore size 22Å
Alkaline/Alkaline Earth Element Content (Ca, K, Li, Mg excluding Na) plus Zn = 44.15 PPM

Example 2

In this example a lube oil fraction was produced by the treatment of wax containing (<10%) oil over a hydrotreating catalyst at about 345° C. at 1000 psia $H_2$ (Total Pressure was 1300 psia), LHSV 0.7 which was then isomerized over a $Pt/F/Al_2O_3$ catalyst at 340° C. $H_2$ pressure of 1000 psi, (total pressure of 1500 psia) LHSV 1.3, then subjected to mild conditions final treatment over a $pt/F/Al_2O_3$ charge at 200° C., $H_2$ pressure 1000 psia (total pressure 1500 psia), LHSV 2.5 and finally dewaxed using MEK/MIBK to a pour point of −21° C. and fractionated. The fraction boiling in the 500° to 800° F. range was evaluated with and without silica treatment to determine their foaming tendencies. The results are shown in Table 3. The treated samples were prepared by flowing wax isomerate oil upflow through a fixed bed (1×25 inches) containing about 109 grams of silica. The silica column was maintained at 24° C. and feed flow rate was 20 cc/min.

TABLE 3

| Foaming Characteristics | | | | |
|---|---|---|---|---|
| Basestock | Silica Gel Grade 12 | | | Silica Gel Grade 646 |
| Sequence 1 | 180/0 | | | 50/0 |
| Sequence 2 | Not Measured (NM) | | | 0/0 |
| Sequence 3 | Not Measured (NM) | | | 70/0 |
| Basestock Anti Foam[1] | 50 ppm | 100 ppm | 200 ppm | 20 ppm |
| Sequence 1* | 155/0 | 135/0 | 35/0 | 0/0 |
| Sequence 2* | NM | NM | NM | 0/0 |
| Sequence 3* | NM | NM | NM | 0/0 |
| Overall Assessment | Fail | | | Pass |
| Daylight Stability Test | Not Performed | | | >107 Day |

*Sequence one is run at 75° F.

TABLE 3-continued

| Foaming Characteristics |
|---|
| Sequence two is run at 200° F. |
| Sequence three involves heating to 200° F., cooling to 75° F. then running test. |

[1]Anti foaming agent is PC 1244 from Dow Corning (a Silicone Antifoaming Agent)

The foam test is the ASTM D892 method.

Example 3

Wax isomerate oil which exhibited unacceptable color ASTM color=0.5 was treated using the two different grades of silica to determine the effect of silica adsorption on color and the treat capacity of the silica should the treatment be successful in improving color. The results are shown in Table 4.

TABLE 4

| Run # | Grade | Pore Size (Å) | gm $SiO_2$ | ml oil | Color | Capacity (ml/g) |
|---|---|---|---|---|---|---|
| 1 | 12 | 22 | 860 | 2200 | 0.1 | 2.5 |
| 2 | 12 | 22 | 826 | 1500 | 0.1 | 2.0 |
| 3 | 646 | 150 | 388 | 3800 | 0.0 | 10.0 |
| 4 | 646 | 150 | 377 | 14500 | 0.0 | 39.0 |

These tests show the benefit of operating with $SiO_2$-646 over conventional $SiO_2$-12. The capacity before breakthrough of color bodies is nearly 20x higher on the 150 angstrom pore diameter material than the 22 angstrom pore diameter material.

Example 4

Additional test runs were performed to determine the maximum capacity of silica gel #646. The results are reported in Table 5.

TABLE 5

| Run | Silica Grade | Pore Size (Å) | gm $SiO_2$ | ml oil | Color | Capacity (ml/g) |
|---|---|---|---|---|---|---|
| BT | 646 | 150 | 109 | 0–4000 | 0.0 | 37.0 |
| | | | | 4000–8000 | 0.1 | 73.0 |
| | | | | 8000–17000 | 0.2 | 156.0 |

The treated samples were prepared by flowing wax isomerate oil upflow through a fixed bed (1×25 inches) containing about 109 grams of silica 646. The column of silica was maintained at 24° C. and the flow rate of the feed was 20 cc/min. The color breakthrough of the effluent from the column was observed for the collected volume as shown in Table 5.

Example 5

The ability of an adsorbent to convert an isomerate oil having an unacceptable oxygenate content into an oil having an acceptable oxygenate content was investigated. The results are shown in Table 6. Prior to any treatment the oil had an oxygenate content of 2300 ppm.

TABLE 6

| $SiO_2$ Grade | $SiO_2$ (gm) | Isomerate oil (ml) | Oxygenates (ppm) |
|---|---|---|---|
| 646 | 104 | 300 | 220 |
| 12 | 820 | 500 | 536 |

Example 5

The adsorption of detrimental components from contaminated isomerate oil using Silica 646 was found to beneficially remove contaminants and improve oil performance but did not otherwise change or alter the characteristics of the oil as compared to uncontaminated isomerate oil or isomerate oil subjected to typical hydrofining and produced an oil comparable to uncontaminated isomerate oil or hydrofined isomerate oil. The results are presented in Tables 7, 8 and 9.

The oils for which results are reported are identified as a clean isomerate oil, an isomerate oil which was contaminated as a result of aging, an isomerate oil which was contaminated as produced and hydrofined or silica treated isomerate oil which was contaminated as produced.

TABLE 7

| | Clean Isom Oil | Contaminated oil (due to Aging) | Contaminated oil (as produced) | HYDROFINER Contaminated oil (as produced) | Silica Cleaned Contaminated oil (as produced) |
|---|---|---|---|---|---|
| 1R Peak at 1720 $cm^1$ | No | No | No | No | No |
| Strong Oxygenates, ppm | Nil | 500 | 1,500 | Nil | Nil |
| KV 100° C., cSt | 5.82 | 5.82 | 5.84 | 5.83 | 5.83 |
| VI | 139 | 143 | 143 | 142 | 142 |
| NOACK, wt loss | 9.1 | 8.8 | 7.8 | 7.5 | 8.2 |
| Pour Point, °C. | −21 | −21 | −18 | −18 | −18 |
| Flash, °C. | 234 | 236 | 239 | 239 | 240 |

TABLE 8

| FOAM | Clean Isom Oil | Contaminated oil (due to Aging) Purfleet Tank 8587 | Contaminated oil (as produced) Fawley Tank 524 | HYDROFINER Contaminated oil (as produced) | Silica Cleaned Contaminated oil (as produced) |
|---|---|---|---|---|---|
| Basestock | | | | | |
| Stage 1 | 100–0 | 400–0 | 140–0 | 20–0 | 50–0 |
| Stage 2 | 20–0 | 10–0 | 50–0 | 0–0 | 0–0 |
| Stage 3 | 100–0 | 350–0 | 250–0 | 20–0 | 70–0 |
| Fully Formulated + 20 ppm Antifoam | | | | | |
| Stage 1 | 0–0 | 90–0 | 200–0 | 0–0 | 0–0 |
| Stage 2 | 0–0 | 20–0 | 100–0 | 0–0 | 0–0 |
| Stage 3 | 0–0 | 120–0 | 300–0 | 0–0 | 0–0 |
| Overall Assessment | Pass | Fail | Fail | Pass | Pass |
| Fully Formulated + 50 ppm Antifoam | | | | | |
| Stage 1 | — | 0–0 | 290–0 | — | — |
| Stage 2 | — | 0–0 | 350–0 | — | — |
| Stage 3 | — | 0–0 | 350–0 | — | — |
| Overall Assessment | — | Pass | Fail | — | — |

TABLE 9

| | Clean Isom Oil | Contaminated oil (due to Aging) Purfleet Tank 8587 | Contaminated oil (as produced) Fawley Tank 524 | HYDROFINER Contaminated oil (as produced) | Silica Cleaned Contaminated oil (as produced) |
|---|---|---|---|---|---|
| USC | | | | | |
| Degradation Temperature, °C. | 184 | 185 | 183 | 185 | 185 |
| INITIATOR INDEX IF 306 | 18.6 | 16.6 | 14.6 | 19.3 | 19.1 |
| Uncatalyzed | | | | | |
| Volatile Acid | 8.3 | 7.4 | 11 | 4.6 | 7.6 |
| Soluble Acid | 26 | 58 | 87 | 54 | 42 |
| Total Acids | 55 | 65 | 77 | 59 | 49 |
| Sludge | 1.3 | 1.0 | 0.9 | 0.9 | 1.0 |
| % Tops | 19 | 22 | 26 | 20 | — |
| Catalyzed | - | | | | |
| Volatile Acid | 8.5 | 7.6 | 11 | 1.5 | 6.4 |
| Soluble Acid | 45 | 36 | 51 | 26 | 36 |
| Total Acids | 54 | 43 | 61 | 27 | 19 |
| Sludge | 1.5 | 0.7 | 0.7 | 0.5 | 0.6 |
| % Tops | 19 | 15 | 20 | 9.2 | 14 |
| PETTER M-1 | | | | | |
| Lacquer Merit | | | | | |
| Land 1 | 0.0 | 1.2 | 0.4 | 0.0 | 4.5 |
| Land 2 | 7.7 | 4.7 | 3.3 | 2.2 | 9.9 |
| Carbon Fill, % | | | | | |
| Groove 1 | 22 | 30 | 48 | 22 | 22 |
| Groove 2 | 44 | 41 | 45 | 38 | 38 |

What is claimed is:

1. A method for the production of a lubricating or specialty oil resistant to deterioration upon exposure to light, heat, and air, and which passes engine performance, foaming, and color tests, which process comprises contacting a hydrocarbon oil selected from wax isomerate oil, and hydrocarbon synthesis liquid product produced by the Fischer Tropsch process, and mixtures thereof with a silica adsorbent, said silica adsorbent being characterized by possessing a pore size of at least 100 Å, an alkali/alkaline earth ion concentration, excluding sodium, of greater than about 125 ppm, an iron content of less than about 40 ppm, and a zirconium content of less than about 130 ppm, said contacting being conducted at a silica loading level of greater than about 1 ml/gram, separating the oil from the adsorbent and recovering the oil as product for use as base oils or additive oils in the production of lube or specialty oils.

2. The method of claim 1 wherein the silica adsorbent has a pore size of at least 125 Å, an alkali/alkaline earth ion concentration preferably greater than about 150 ppm, an iron content of less than about 30 ppm and a zirconium content of less than 115 ppm.

3. The method of claim 1 wherein the silica adsorbent has a pore size of at least 150 Å, an alkali/alkaline earth ion concentration, excluding sodium, of greater than about 300 ppm, an iron content of less than about 25 ppm and a zirconium content of less than about 100 ppm.

4. The method of claim 1, 2 or 3 wherein the hydrocarbon oil is contacted with the silica adsorbent at a silica loading level of about 2.5 to 3000 ml/gm.

5. The method of claim 1, 2 or 3 wherein the hydrocarbon oil is contacted with the silica adsorbent at a silica loading level of about 10 to 150 ml/gram.

6. The method of claim 1, 2 or 3 wherein the contacting is performed under continuous conditions using a fixed bed, a moving bed, a simulated moving bed or a magnetically stabilized fluidized bed.

7. The method of claim 1, 2 or 3 wherein the contacting is conducted for a period of less than 2 hours.

* * * * *